United States Patent [19]

Best

[11] Patent Number: 4,564,551

[45] Date of Patent: Jan. 14, 1986

[54] WET-PRESSING BELT FOR PAPER MACHINES

[75] Inventor: Walter Best, Duren, Fed. Rep. of Germany

[73] Assignee: Thomas Josef Heimbach GmbH & Co., Duren, Fed. Rep. of Germany

[21] Appl. No.: 572,888

[22] Filed: Jan. 16, 1984

[30] Foreign Application Priority Data

Jun. 28, 1983 [EP] European Pat. Off. ..... 106268.2

[51] Int. Cl.[4] ..... D03D 13/00

[52] U.S. Cl. ..... 428/222; 162/DIG. 1; 428/224; 428/131; 428/138; 428/257

[58] Field of Search ..... 428/222, 223, 224, 225, 428/257, 258, 259, 131, 138; 162/DIG. 1

[56] References Cited

U.S. PATENT DOCUMENTS

| | | | |
|---|---|---|---|
| 4,206,258 | 6/1980 | Balcar | 428/131 |
| 4,392,902 | 7/1983 | Lefferts | 428/222 |
| 4,415,625 | 11/1983 | Borel | 428/222 |
| 4,446,187 | 5/1984 | Eklund | 428/131 |
| 4,481,079 | 11/1984 | Davis | 428/222 |

FOREIGN PATENT DOCUMENTS

| | | |
|---|---|---|
| 2419751 | 12/1975 | Fed. Rep. of Germany . |
| 3231039 | 3/1983 | Fed. Rep. of Germany . |
| 2106557 | 4/1983 | United Kingdom . |

*Primary Examiner*—James J. Bell

*Attorney, Agent, or Firm*—Shlesinger, Arkwright, Garvey & Fado

[57] ABSTRACT

A belt to be used in paper-machine wet-pressing, in particular in a machine with an extended pressing gap, includes a flexible, liquid-impermeable belt stratum which is smooth on its back side.

This belt is improved by providing the front side of the belt stratum (2,12,25,36) with a structured surface with open longitudinal and/or transverse channels (9,14,30,41), for the purpose of water drainage, which cannot be squeezed, or only insignificantly, under press compression.

20 Claims, 7 Drawing Figures

WET-PRESSING BELT FOR PAPER MACHINES

BACKGROUND OF THE INVENTION

The invention concerns a belt to be used in paper-machine wet-pressing, in particular with an extended pressing gap. The belt is provided with a smooth, liquid-impermeable coating on its back side.

A substantial part of the liquid still present in the paper web is forced out by the wet-presses of paper machines. Compression rollers are used for this purpose and jointly form a pressing gap, through which passes the web and a revolving felt cloth. Due to the pressure applied in the pressing gap, the liquid is forced from the web and into the felt cloth, from which it is then drained.

Recently, wet-presses with an extended gap, the so-called nip-presses, have been developed. The web is moved over a longer path and accordingly, is exposed for a correspondingly longer time to high press squeezing so that and hence the web leaves the wet press in a drier state. Such wet presses have been disclosed, for instance, in the German Auslegenschriften Nos. 23 38 414 and 24 13 280, in U.S. Pat. Nos. 3,808,092 and 3,970,515 and in German Auslegeschrift No. 29 35 630 and German Offenlegungsschrift No. 29 35 630. Two basically different designs have been developed in the prior art.

In one design, the webs and one or two felt cloths pass between two liquid-impermeable belts in the pressing gap. The pressing gap is defined by two compression chambers or rollers resting against the back sides of said belts. The compression rollers are hydraulically actuated so that they compress from both sides the belts, the webs and the felt cloths passing between them.

In the other design, the web is guided over a section of one or more compression rollers, with a pressure being applied across this section in the direction of the compression roller. This is implemented too by a hydraulically actuated compression chamber acting on a flexible, liquid-impermeable belt revolving jointly with the web and the felt cloth.

The belts used for the above cited purposes are flexible plastic belts smooth on both sides. The plastic is resistant to the liquid used in the compression chambers and has high abrasion resistance. These belts cannot absorb the water forced from the web and therefore all of the water from the felt cloth(s) must be drained. Because of the high compression and the comparatively long compression path, the amount of water is larger than when wet-pressing without the extended pressing gap is utilized.

OBJECTS AND SUMMARY OF THE INVENTION

It is the object of the invention to discover how the dehydration in paper-machines wet-presses using the belts cited initially, that is, in particular, in wet-pressing with extended pressing-gaps, can be improved.

This problem is solved by the invention in that the front side of the belt stratum—which amounts to most of the thickness of the belt—is provided with a structured surface having open lengthwise and/or crosswise water-draining channels which are substantially or entirely incompressible under the press compression.

This solution is based on the concept of providing a dual function for the belt which is revolving along anyway, namely, on one hand, to assume the pressure transmission to the web and, on the other hand, to assume the drainage of the water forced from the web. It was found that the dehydration can be substantially improved by this structuring of the front side of the belt stratum and that this entails only minor additional costs. The term "front side" denotes that side of the belt which faces the web, i.e. the felt cloth(s), while the back side is loaded by the compressing medium.

In the embodiment of the invention, the structured surface consists of a plurality of mutually engaging filamentary loops with alternating clockwise and counter-clockwise pitches and which loops are partly embedded into the belt stratum. Such structures formed by filamentary loops are known from the German Offenlegungsschrift No. 24 19 751 as belts of filament segments. They are characterized in the present combination by forming longitudinal or transverse channels, depending on their direction, and these channels are open towards the top and thereby provide good water drainage. They are dimensionally stable to the extent that, at the prevailing wet-pressing compression pressures generated in extended pressing gaps, they will not be squeezed together, and therefore the channels always stay open.

Preferably the filament loops always consist of two substantially straight loop-legs and of end-arcs connecting these. The surface formed by the filament loops is so plane that markings are avoided and felt-abrasion is reduced to a minimum.

To improve the dimensional stability of the structured surface consisting of the filament loops, the latter preferably are mutually connected by coupling filaments in the areas of overlap. Additionally multifilaments and/or single filaments can be inserted into the filament loops and be appropriately embedded in the belt stratum. These increase the dimensional stability of the belt in the direction of their orientation and also improve the adhesion of the filament loops to the belt stratum.

Alternatively to the use of the filament loops, the structured surface also can be obtained using a fabric which is at least double ply and the weave of which forms the longitudinal and/or transverse channels. The fabric being partly embedded in the belt stratum. Particularly, compression-proof strainer fabrics, such as are used in the wet end of paper machines, are applicable for this purpose.

To make it possible to form the longitudinal and/or transverse channels, the yarns extending in one direction of the fabric can be made substantially thicker than those extending in the other. To keep the channels open, the number of yarns in the fabric's outer ply should be substantially fewer than those in the inner ply.

In an especially preferred embodiment, the belt of the invention is open-ended and is provided with lap strips which can be joined in the paper machine. This simplifies substantially the belt installation in the paper machine. The lap strips should overlap longitudinally so that the pressure on the belt exerted by the compression chambers in the area of overlap is applied in sealing manner. Additionally one of the lap strips can be provided on that side facing the other lap strip with a cross-sectional contour, for instance a transverse square groove engaged by a particular matching shape, for instance a transverse rib on the other lap strip. A positive locking lap closure is achieved in this manner. The thickness of the lap strip should be such that in the superposed condition it will have the same thickness as the belt stratum. Moreover, at least one of lap strips may be equipped with a sealing or adhesive substance on the side facing the other lap strip. Again, the leading edge of at least one of the lap strips should be bevelled and should rest on the inside surface against a corresponding bevel of the particular other lap strip.

Where the structured surface of the belt of the invention is formed by the transverse filament loops, those abutting the lap can be joined together in simple manner so that their structure in the area of the lap will remain constant. The junction can be additionally stabilized in this case by coupling filaments. In the case where the structured surface is formed by a fabric or longitudinal filament loops, a fine special seam is provided for making it possible to seal the fabric or filament loops to the belt stratum. In this way, a continuously structured surface is achieved in this region.

DESCRIPTION OF THE DRAWINGS

The invention is shown in closer detail in relation to the embodiments of the drawing.

DESCRIPTION OF THE INVENTION

Figure 1:
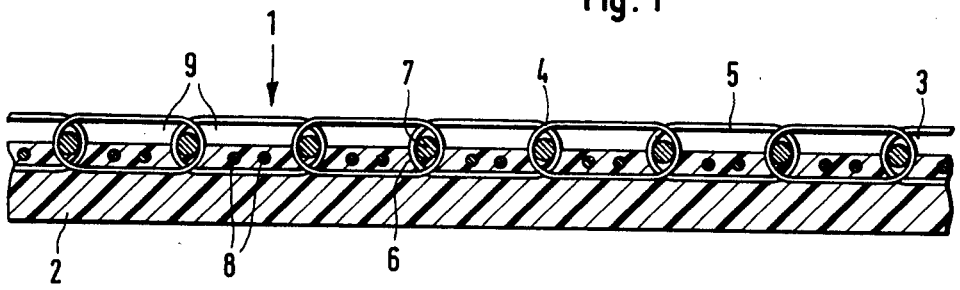
FIG. 1 is a cross-section of a wet-pressing belt of a paper machine
Figure 2:
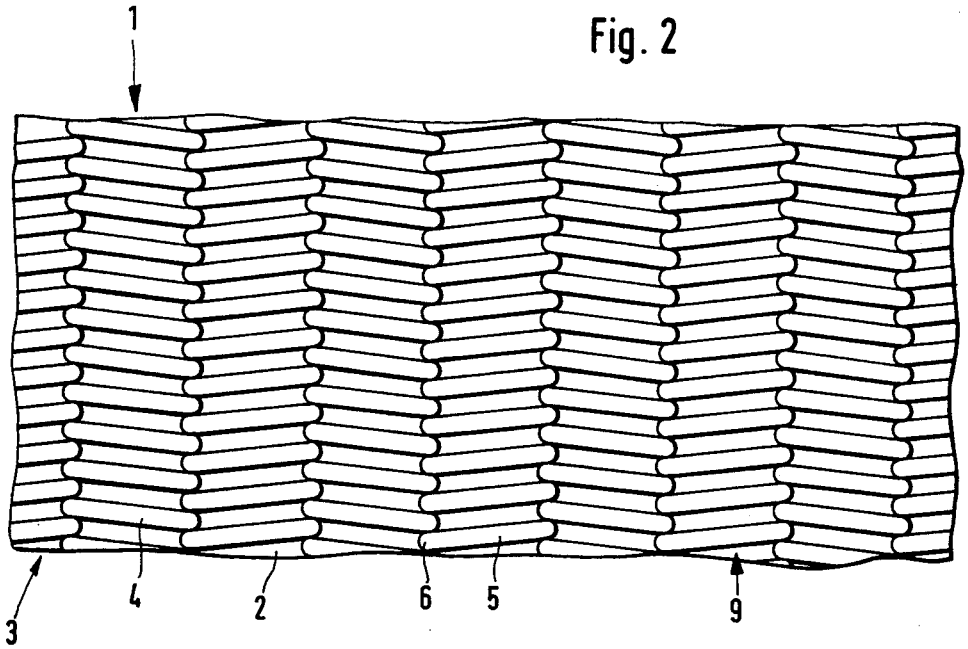
FIG. 2 is a partial topview of the belt of FIG. 1

The belt shown in FIG. 1 is a cross-section transverse to the direction of advance while FIG. 2 shows a partial topview thereof. The belt 1 consists of a belt stratum 2 having an embedded filament structure 3 which has, for instance, its lower part disposed in the front side of said belt 1.

The filament structure 3 consists of a plurality of individual filament loops 4, arranged in the direction of advance of the belt 1 and disposed parallel to each other. The loops 4 are flattened in such a manner that semi-circular end-arcs 6 join the straight loop legs 5. The straight loop legs 5 provide an open yet relatively flat surface preventing markings and felt abrasion.

The end-arcs 6, of the single filament loops 4, overlap and define openings permitting coupling filaments 7 to pass therethrough for the purpose of providing a positive connection between the single filament loops 4. Longitudinal filaments 8 may pass between the loop legs 5 and be embedded in the belt stratum 2. The longitudinal filaments 8 improve the strength of the belt 1 in the longitudinal direction.

As shown in particular by FIG. 1, longitudinal channels 9 are formed by the filament loops 4 and permit water drainage when the belt 1 is used for wet-pressing, especially when an extended pressing gap is utilized. In that application, a pressure is most often exerted by a hydraulically actuated compression chamber on the smooth back side of the belt 1. This pressure is transmitted by the filament loops 4 to a felt cloth and a paper web. This web rests, either directly or through another felt cloth, on a roll. The compression forces the water from the felt cloth. From there the water can be drained through the longitudinal channel 9 formed by the filament loops 4. In the present embodiment, this drainage is carried out in the longitudinal direction. The dimensional stability of the filament loops 4 is such that they will not be forced together during the compression.

FIG. 2 shows that the longitudinal channels 9 are open upwards on account of the spacing between the individual loop-legs 5. Consequently, the water from the felt cloth can flow without significant impediment into the longitudinal channels 9 and drain from there.

Figure 3:
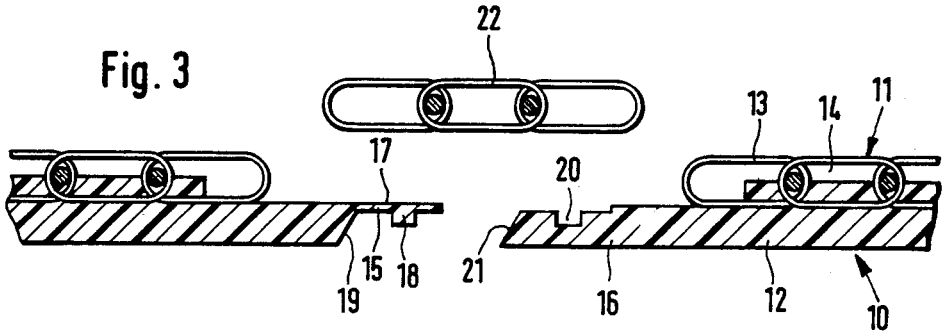
FIG. 3 is a longitudinal section of the ends of another belt for the wet press of a paper machine
Figure 4:
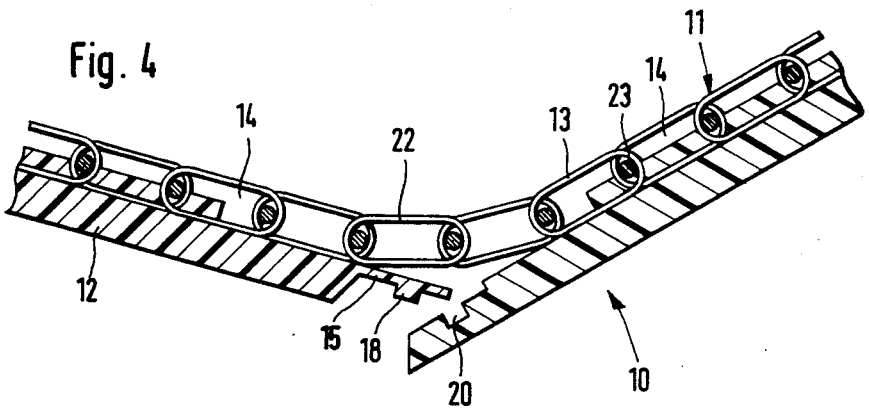
FIG. 4 is the longitudinal section of FIG. 3 in an intermediate position before the coupling of the belt ends
Figure 5:
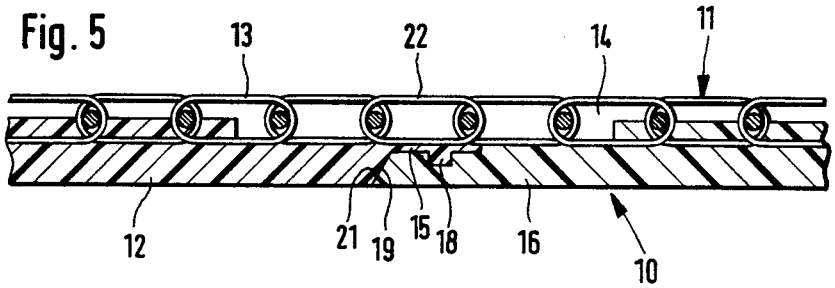
FIG. 5 is the longitudnal section of FIGS. 3 and 4 disclosing the coupled position of the belt ends

FIGS. 3 through 5 show another embodiment of the belt 10 of the invention, represented as a section in the direction of advance of this belt 10, namely near the lap. This belt 10 differs from the belt 1 shown in FIGS. 1 and 2 merely in that the filament structure 11—which otherwise is identical in all respects—now is rotated by 90° is embedded in the belt stratum 12. In this way, the filament loops 13 of the filament structure 11 form cross-channels 14 extending in the transverse direction. The water pressed from the web and the felt cloth, in this instance, therefore is drained toward the sides of the belt 10.

In this embodiment the ends of the belt 10 can be coupled in an especially simple manner. For that purpose, the belt 10 is provided at both ends with lap strips 15 and 16. The lap strip 15 of the end of belt 10 shown to the left in this Figure is recessed along side 17 so that the filament structure 11 lies free. Its lower side also is cleared or recessed, and in such a manner that a cross-boss 18 is formed which extends over the entire width of the lap strip 15 and projects downwardly. The lap strip 15 is provided with a bevel 19 facing the belt 10.

The lap strip 16, which in FIG. 3 is at the right end of the belt 10, is cleared only along its top side. A cross-groove 20 is disposed there and matches the cross-boss 18—which it receives-of the other lap strip 15. The lap strip 16 has a bevel 21 toward the free edge, this bevel 21 corresponding to bevel 19.

FIG. 3 shows the lap strips 15 and 16 when they are still apart. Above the lap strips 15 and 16, is a bridging filament structure 22 consisting of three filament loops 13. This bridging filament structure 22 is connected by coupling filaments 23 to the filament structure 11 embedded in the belt stratum 12, whereby the structure 11 is now closed or coupled.

As shown in FIG. 4, the lap strips 15 and 16 are moved together, and placed on each other, so that the cross-boss 18 enters the cross-groove 20 and the bevels 19 and 20 rest against each other along the mutually facing sides of the lap strips 15 and 16. In operation, these faces are forced on each other by the press compression and a liquid-impermeable connection is automatically obtained thereby. It is possible to further enhance the tightness of this connection by previously depositing an adhesive on at least one of the opposite sides of the lap strips 15 and 16. The thicknesses of the lap strips 15 and 16 are mutually adjusted so that the overall thickness, in the asseembled state, is constant and uniformity is preserved.

Figure 6:
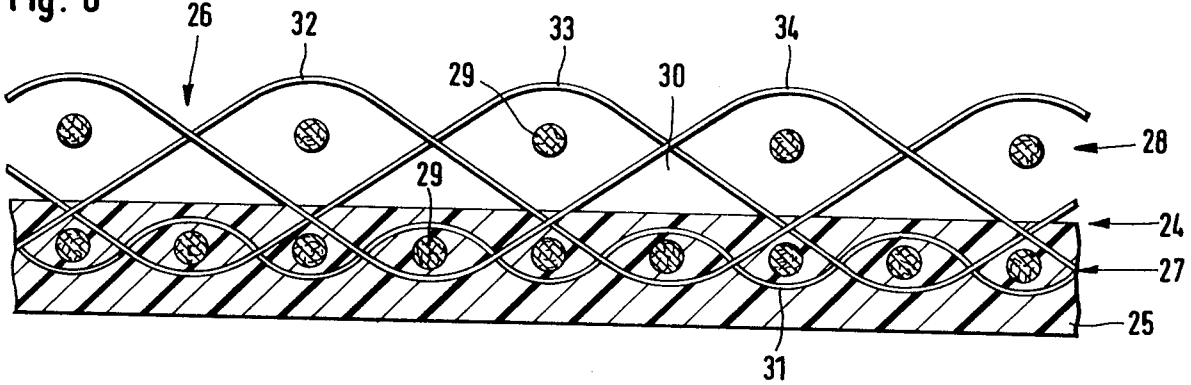
FIG. 6 is a cross-section of another belt for the wet press of a paper machine.

FIG. 6 shows another embodiment of the invention. The cross-sectionally represented belt 24 consists of a belt stratum 25 and of a compression-proof fabric 26 embedded along its lower part in the stratum 25.

The fabric 26 is made of two plies. The lower ply 27 is located within the belt stratum 25 and the upper ply 28 is spaced from the front-side surface of the belt stratum 25. Both plies 27 and 28 are formed with relatively thick warp yarns 29 extending in the direction of advance of the belt 24. The number of the warp yarns 29 in the lower ply 27 being double that of the warp yarns in the upper ply 28. Therefore, there is only one warp yarn 29 in the upper ply 28 over every second warp yarn 29 in the lower ply 27. In this way, the fabric 26 is open upwards and broad longitudinal channels 30 are formed between the warp yarns 29.

The warp yarns 29 of the lower ply are bound by filling yarns 31 which extend only within the belt stratum 25. The binding is performed in such a manner that the filling yarns 31 pass alternatingly on the topside of one warp yarn and on the lower side of the next warp yarn, etc.

The above-stated system of filling yarns alternates with the filling yarns 32,33 and 34 which provide the connection between the lower ply 27 and the upper ply 28 of the fabric 26. These filling yarns 32,33 and 34 are arranged so that they bind alternatingly every sixth warp yarn 29 of the lower ply 27 and then every third warp yarn 29 of the upper ply 28, being offset each time by one warp yarn in the upper ply 29 in the direction of the filling yarns in the manner of a satin weave. A fabric 26 so built is practically never squeezed together under press compression, and, accordingly, the longitudinal channels 30 remain open and free to drain the water.

Figure 7:
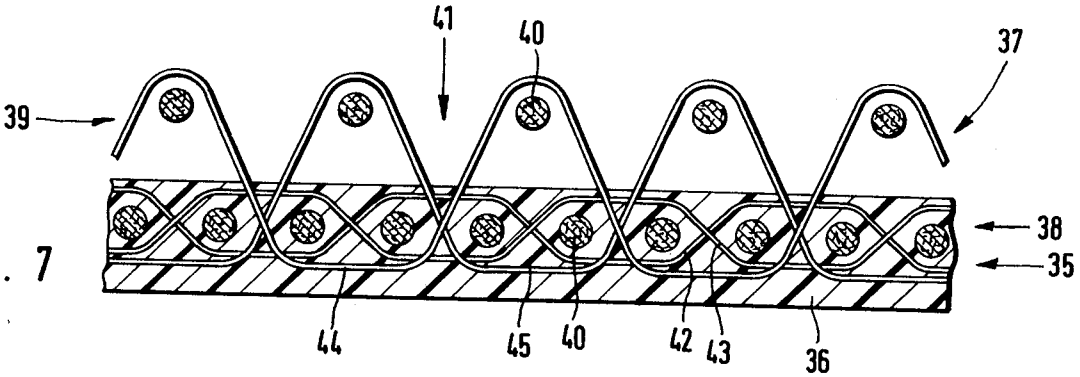
FIG. 7 is a cross-section of another belt for the wet press of a paper machine.

FIG. 7 shows a belt 35, into the stratum 36 of which is embedded the lower part of a fabric 37 of a different design.

This fabric 37 is also made of two plies, the lower ply 38 being within the belt stratum 36 and the upper ply 39 being spaced from the surface of this stratum 36. As in the embodiment of FIG. 6, in this case too the two plies 38 and 39 are formed by relatively thick warp yarns 40 extending in the direction of advance of the belt 35. The number of warp yarns 40 in the lower ply 38 being twice that in the upper ply 39. However, the warp yarns 40 in the upper ply 39 are offset in such a manner that they are located every time above the gap between two warp yarns 40 in the lower ply 38. The warp yarns 40 of the upper ply 39 form broad longitudinal channels 41 to drain water from the web and the felt cloth.

A separate system of filling yarns, including filling yarns 42 and 43 is provided to tie the warp yarns 40 in the lower ply 38. The yarns 42 and 43 extend within the belt stratum 36. The warp yarns 42 and 43 each time bind two adjacent warp yarns 40 to one side before changing sides. Furthermore, these warp yarns 42 and 43 are always mutually offset by two warp yarns 40, as seen in the direction of the filling yarns.

The connection between the lower ply 38 and the upper ply 39 is further implemented by filling yarns 44 and 45. Each of these filling yarns 44 and 45 first ties one warp yarn 40 in the upper ply 39 and then two warp yarns 40 in the lower ply 38, before returning upward. Also, the filling yarns 44 and 45 are mutually offset in the direction of the filling yarns in this case as well, namely, each time by one warp yarn 40 of the upper ply 39.

This fabric 37 also is compression-proof, so that the longitudinal channels 41 are also kept intact in the pressing gap. Therefore, water drainage is assured in this critical region.

Applicable materials for the belt strata 2,12,25 and 36 predominantly include elastic, but also thermosetting or thermoplastic polymers, the polymer being determined by the particular application. Typical examples are polyurethane, butadiene-styrene resins, epoxy resins, chlorinated rubber, PVC and polyacrylates, among the commercial polymers. The filament structures 3,11 can be made of synthetic polymers, such as PES or PA.

I claim:

1. A paper machine dehydration belt, comprising:
(a) a liquid impermeable belt stratum;
(b) a plurality of consecutively arrayed water drainage channels disposed along a first face of said stratum for draining water away therefrom;
(c) each of said channels defined by a plurality of adjacently disposed filamentary loops and each of said loops having a portion thereof disposed in said stratum and a portion extending beyond said first face;
(d) each of said loops comprised generally of substantially straight first and second legs and end portions connecting the legs; and,
(e) each loop of a channel having an end portion disposed between and pivotally connected by means with the end portions of the adjacent loops of the adjacent channels so that the loops of said channels are successively disposed with clockwise and counterclockwise pitches.

2. The belt as defined in claim 1, wherein:
(a) the end portions of the loops of adjacent channels overlap and define openings; and,
(b) coupling filaments pass through said openings and thereby pivotally interconnect the loops of adjacent channels.

3. The belt as defined in claim 1, wherein:
(a) a plurality of filaments being disposed within said stratum and being aligned with said channels and overlying the portion embedded in said stratum for improving the strength of said belt.

4. The belt as defined in claim 1, wherein:
(a) said channels extending in the longitudinal direction of said stratum.

5. The belt as defined in claim 1, wherein:
(a) said channels extending transverse to the longitudinal direction of said stratum.

6. The belt as defined in claim 1, wherein:
(a) said stratum having first and second end portions; and,
(b) means interconnecting said end portions for thereby providing a continuous belt.

7. The belt as defined in claim 6, wherein:
(a) said interconnecting means including first and second lap strips, each of said lap strips associated with one of said end portions; and,
(b) said lap strips being secured together.

8. The belt as defined in claim 7, wherein:
(a) a cross-boss being associated with said first lap strip; and,
(b) a cross-groove being associated with said second lap strip and being adapted for receiving said cross-boss for thereby securing said lap strips together.

9. The belt as defined in claim 7, wherein:
(a) adhesive means being associated with one of said lap strips for securing said lap strips together.

10. The belt as defined in claim 7, wherein:
(a) said first lap strip having a beveled portion; and,
(b) said second lap strip having a beveled portion cooperating with said first lap strip beveled portion so that said beveled portions rest against each other and thereby provides a liquid impermeable seal when said lap strips are secured together.

11. A dehydration belt for extended pressing gaps of paper machines, comprising:
(a) a liquid impermeable belt stratum;
(b) a plurality of individual filamentary loops, each of said loops having first and second substantially straight leg portions and arcuate end portions associated therewith for connecting the legs of a loop;
(c) said loops disposed in a plurality of generally aligned consecutively disposed rows and with the first leg of each loop embedded in said stratum and with the second leg thereof disposed above said stratum so that said second legs and said end portions cooperate with the outer face of said stratum for providing a plurality of drainage channels;
(d) the loops of each row disposed in spaced parallel relation;
(e) the loops of each row being angularly disposed relative to the loops of the immediately precedent and subsequent rows so that the loops of said channels have an alternating clockwise and counter-clockwise orientation;
(f) the end portions of the loops of each row overlap and provide a plurality of openings; and,
(g) means extend through said openings and pivotally interconnect said loops of each of said rows.
12. The belt as defined in claim 11, wherein:
(a) said connecting means including a plurality of filaments.
13. The belt as defined in claim 11, wherein:
(a) a plurality of filaments being embedded in said stratum and overlying said first legs; and,
(b) said filaments being longitudinally aligned with said rows for strengthening said belt.
14. The belt as defined in claim 11, wherein:
(a) said stratum having first and second end portions; and,
(b) means securing said end portions together for thereby providing a continuous belt.
15. The belt as defined in claim 14, wherein:
(a) each of said end portions including a lap strip and said lap strips being secured together.
16. The belt as defined in claim 15, wherein:
(a) a cross-groove extending along one of said lap strips; and,
(b) a cross-boss extending along the other lap strip and being positionable in said cross-groove for thereby securing said strips together.
17. The belt as defined in claim 15, wherein:
(a) adhesive means securing said lap strips together.
18. The belt as defined in claim 15, wherein:
(a) each of said lap strips having a beveled portion; and,
(b) said beveled portions conforming when said lap strips are secured together for thereby providing a liquid impermeable seam.
19. The belt as defined in claim 11, wherein:
(a) said channels extending longitudinally of said stratum.
20. The belt as defined in claim 11, wherein:
(a) said channels extending transverse to the longitudinal direction of said stratum.

* * * * *